United States Patent [19]

Rossi

[11] 4,130,316

[45] Dec. 19, 1978

[54] STEP LADDER/CHAIR COMBINATION

[75] Inventor: Joseph V. Rossi, Chicago, Ill.

[73] Assignee: Comfort Lines, Inc., Chicago, Ill.

[21] Appl. No.: 866,485

[22] Filed: Jan. 3, 1978

[51] Int. Cl.[2] ..... A47C 4/00

[52] U.S. Cl. ..... 297/46; 182/33; 182/156

[58] Field of Search ..... 277/46, 60, 16, 30; 182/156, 159, 33, 33.3

[56] References Cited

U.S. PATENT DOCUMENTS

| | | | |
|---|---|---|---|
| 478,662 | 7/1892 | Tuttle | 182/33 X |
| 2,627,300 | 2/1953 | Wohler et al. | 297/46 |
| 2,699,815 | 1/1955 | Vanderminden | 297/60 X |
| 3,058,544 | 11/1962 | Rossi et al. | 182/156 X |
| 3,086,812 | 4/1963 | Eads | 297/30 |
| 3,227,243 | 1/1966 | Bates et al. | 182/156 |

*Primary Examiner*—James T. McCall
*Assistant Examiner*—Peter A. Aschenbrenner
*Attorney, Agent, or Firm*—Mason, Kolehmainen, Rathburn & Wyss

[57] ABSTRACT

A step ladder/chair combination comprises a first and second spaced apart step and seat platforms which are supported from a first pair of parallel legs pivotally interconnected to the platform and a second pair of parallel legs are pivoted to the seat. The second legs include lower ends or feet which are movable outwardly away from the feet on the first pair of legs to an expanded condition wherein the step ladder/chair assumes a self-supporting, standing position on a floor or other surface ready for use. The step ladder/chair also includes a third pair of parallel legs which are parallel to the first legs and extend upwardly above the chair platform to support a back rest. The third legs are pivotally connected to the step and seat platforms. Short linkages are provided to pivotally interconnect the second and third legs and thereby limit the relative pivotal movement of the second legs relative to the first legs so that the step ladder/chair may be maintained in a collapsed or folded position for storage and the like occupying a minimum space or when pivoted outwardly to an expanded or self-supporting standing position may be used as a seat or a step ladder.

10 Claims, 3 Drawing Figures

FIG. 1
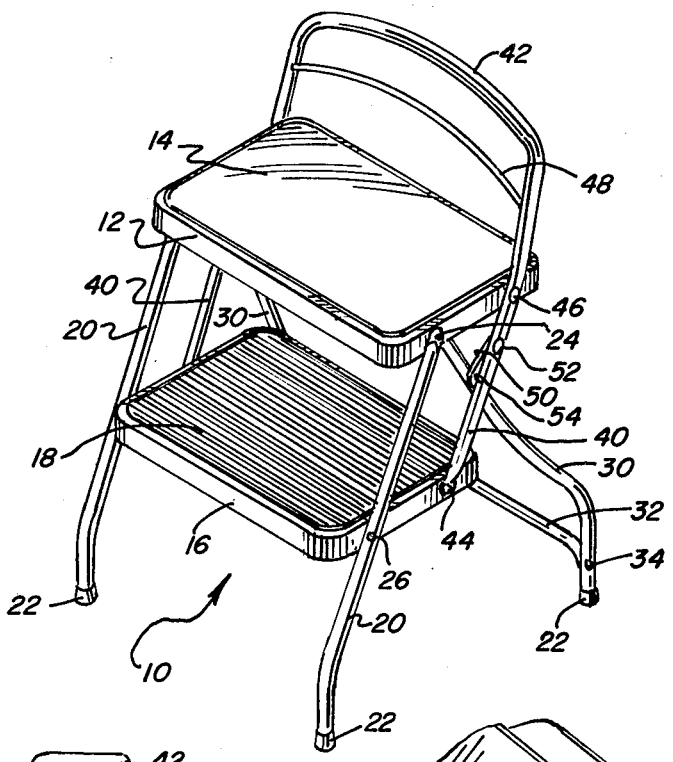
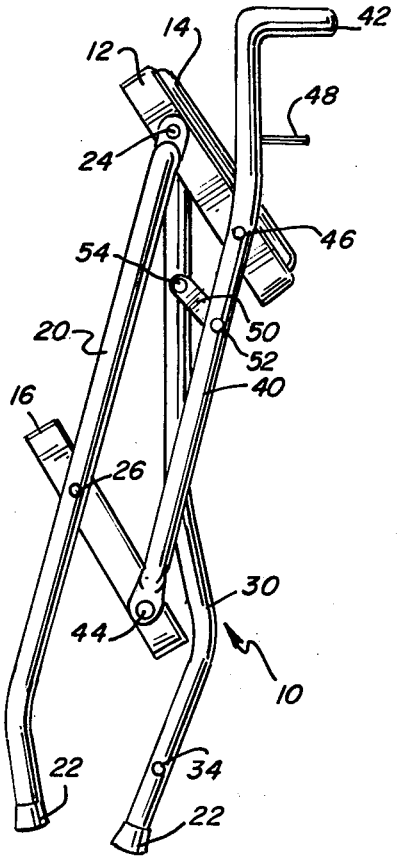
FIG. 2
FIG. 3
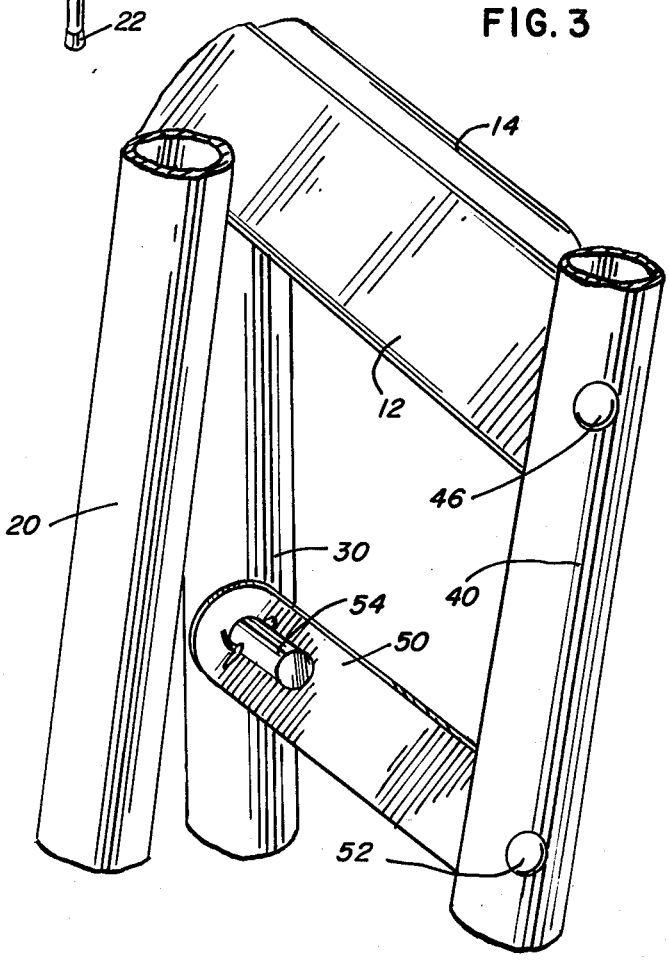

STEP LADDER/CHAIR COMBINATION

BACKGROUND OF THE INVENTION

The present invention relates to a new and improved step ladder/chair combination which is useful around the household as a chair or stool and which also is used as a relatively short, light in weight, and easily manipulated step ladder. The step ladder/chair combination in accordance with the present invention offers a number of advantages in that is is pleasing in appearance, occupies a minimum amount of volume or space when in a folded or collapsed position and yet provides an extremely sturdy chair or step ladder for use in supporting a person or other objects when it is expanded in a self-supporting, standing condition. The step ladder/chair combination is easy to use, relatively light in weight and economical to manufacture, making it well within the reach of the average householder. The step ladder/-chair may be utilized as an aid when painting, wall papering, and cleaning and is useful as well in a host of other household tasks. In addition to its function as a step ladder, the device is useful as a simple chair for seating at a table or the like in a kitchen or utility room. The device includes a lower level step or platform which is suitable for a variety of uses and which is positioned at a level convenient for stepping on. The upper level platform or seat can also be used for supporting a variety of objects in addition to serving as a seat. The device includes a back rest which is also useful in retaining objects placed on the upper seat platform for preventing these objects from falling.

Accordingly, it is an object of the present invention to provide a new and improved step ladder/chair combination.

More particularly, it is an object of the present invention to provide a step ladder/chair combination which is neat in appearance, relatively light in weight and easy to handle and manipulate, yet sturdy and collapsable to occupy a minimum space when the device is not in use, It is another object of the present invention to provide a new and improved step ladder/chair combination which is extremely stable when expanded to a self-supporting standing condition and which serves a multiple purpose as a chair, a step ladder and a device useful for supporting a number and wide variety of objects at a convenient level useful during household chores.

SUMMARY OF THE INVENTION

The foregoing and other objects and advantages of the present invention are accomplished in a new and improved embodiment of a step ladder/chair combination which comprises first and second platform means in spaced apart parallel relation for supporting a person(s) or an object(s) at convenient levels above a floor or other supporting surface. The step ladder/chair includes a first pair of parallel legs which are pivotally interconnected to the first and second platforms on opposite sides and these legs depend downwardly from the lower platform and have feet at their lower ends for supportive non-skid contact with the floor or other surface. A second pair of parallel legs is pivotally connected to the upper platform on opposite sides thereof and these legs depend downwardly, also having feet at their lower end for supportive non-skid contact with the floor or other support surface. The feet on the second pair of legs are movable toward and away from those on the first pair of legs upon relatively pivotal movement between these legs so that the step ladder/-chair may be placed in a folded or collapsed first condition for storage or non-use and occupying only a minimum space or volume. When ready for use, the legs may be pivoted apart to provide spread spacing of the feet so that the step ladder/chair assumes a self-supporting, steady and stable standing position on the floor or other supporting surface. A third pair of parallel legs is provided parallel of the first pair of legs and pivotally interconnected to the first and second platforms on opposite sides thereof. The third pair of legs extend upwardly above the upper platform or seat and these legs support a back rest which is spaced above the upper seat for supporting the back of a person sitting on the seat. A pair of short linkage elements are pivotally interconnected at opposite ends to pairs of adjacent second and third legs intermediate their length between the upper and lower platforms. These linkage elements and a pair of stops, limit the relative pivotal movement between the adjacent pairs of first and second legs to provide a stable, self-supporting position of the step ladder/chair with the feet spread widely apart. The first and second platforms are maintained in spaced apart, generally horizontal parallel relation at convenient levels above the floor or other supporting surface when the device is in use.

BRIEF DESCRIPTION OF THE DRAWINGS

For better understanding of the features of the present invention, reference should be had to the following detailed description taken on conjunction with the drawings, in which:

FIG. 1 is a front perspective view of a new and improved step ladder/chair combination constructed in accordance with the features of the present invention and shown in an expanded condition ready for use as a chair or step ladder;

FIG. 2 is a side elevational view of the step ladder/-chair combination shown when it is in a collapsed or folded condition for storage when not in use; and FIG. 3 is an enlarged perspective view of a portion of the step ladder/chair combination of FIG. 1 illustrating the relation of the legs, platforms, linkage and stops.

DESCRIPTION OF THE PREFERRED EMBODIMENT

Referring now more particularly to the drawings, in FIG. 1 is illustrated a new and improved step ladder/-chair combination constructed in accordance with the features of present invention and referred to generally by the reference numeral 10. In FIG. 1, the step ladder/chair is shown with the lower portions of the legs in expanded position so that the device assumes a self-supporting, erect position ready for use as a chair, step ladder or means for supporting a variety of different objects useful around the house. In FIG. 2, the step ladder/chair is shown in a collapsed or folded condition occupying a minimal amount of space or volume. In this condition, the device may be conveniently carried or stored away in a closet or storage area when not in use.

The step ladder/chair includes an upper platform or seat 12 of generally rectangular shape and preferably formed of a sheet metal stamping including a relatively flat rectangular upper surface and a depending peripheral skirt. The upper surface is provided with a resilient cushion 14 in order to provide seating comfort when the device is used as a chair. Below and parallel with the upper platform seat 12, the device includes a lower platform or step 16 also preferably formed of a sheet metal stamping and the step includes a relatively flat, rectangular upper surface and a depending peripheral skirt. A generally rectangular, non-skid covering of rubber or other material 18 is applied to the upper surface of the lower step 16. The upper and lower platforms 12 and 16 are maintained in spaced apart, generally horizontal parallel relation above the floor or other support surface by means of a first pair of front legs 20, preferably formed of hollow tubular metal and having rubber or plastic non-skid feet 22 on the lower ends to provide positive contact with the floor. The upper ends of the front legs 20 are pivotally connected to opposite sides of the skirt on the upper seat 12 by means of rivets or other suitable fasteners 24 which serve as pivot pins between the front legs and the upper platform. Similarly, the lower platform 16 is pivotally attached to the front legs 20 by means of rivets 26 which extend through the opposite sides of the depending skirt of the lower step. The step ladder/chair also includes a second pair or legs 30 preferably formed of hollow tubular steel and pivotally connected to the opposite sides of the skirt on the upper seat platform 12 by means of the same rivets 24 which secure the upper ends of the front legs 20. Preferably, the upper end portions of the rear legs 30 are attached to the skirt of the upper seat 12 inside of the front legs 20 and as shown in FIG. 2, the upper end portions of both front and rear legs are flattened to provide a flat portion having an aperture therein for accommodating the pivot axles which preferably take the form of headed rivets 24.

The lower end portions of both the front and rear legs 20 and 30 are curved as shown in FIG. 1 to be generally upright and the lower ends of the rear legs are provided with rubber feet 22 like those on the front legs 20. The rear legs 30 are interconnected adjacent their lower end portions by a U-shaped transverse cross-member 32 having a central bight portion and a pair of relatively short, down turned legs at opposite ends which are secured to the lower portions of the rear legs 30 by means of rivets 34. The cross-member 32 is preferably formed of tubular steel and the downturned legs at opposite ends are deformed to fit closely against the inside surface of the lower portions of the rear legs 30 for providing a strong interconnection between the rear legs.

In accordance with the present invention, the step ladder/chair also includes a third pair of legs 40 which are integrally joined to an upper, curved transverse cross-member 42 which serves as a back rest for the step ladder/chair. The lower ends of the legs 40 are secured to the skirt of the lower step 16 on opposite sides by means of rivets 44 which serve as pivot pins permitting free pivotal movement between the legs and the lower step 16. The third legs are also interconnected by means of rivets 46 to opposite sides of the skirt on the upper seat 12 and the portions of the legs between the pivotal connections to the seat and step are aligned in parallel with the upper portions of the front legs 20 as best shown in FIGS. 1 and 2. This provides a parallelogram linkage so that the spacing between the front legs and the legs 40 may vary as the step ladder/chair is collapsed or folded for storage (FIG. 2) and when the ladder/chair is opened up or expanded ready for use as shown in FIG. 1. The parallelogram linkage formed by the legs 20 and 40 and the seat 12 and the step 16 provide for continuous parallel relation between the legs, and between the step and the seat to ensure that the seat and step are always in a generally horizontal position when the step ladder/chair is opened up as shown in FIG. 1 and placed upon a generally horizontal supporting surface or floor ready for use.

The back rest which is provided by the integrally formed connecting bight portion 42 at the upper ends of the legs 40 is further supplemented by means of a lower, relatively smaller, transverse cross-member or curved shape indicated by the reference numeral 48. This lower cross-member is secured at opposite ends to the legs 40 and provides additional back support for a person seated on the cushion 14.

In accordance with the present invention, excellent stability for the step ladder/chair is ensured and provided by positively limiting the relative pivotal movement between the front legs 20 and the rear legs 30 which are connected to a common pivot axis at their upper ends as illustrated. A pair of relatively short, linkage members 50 are disposed on opposite sides of the step ladder/chair structure and are pivotally interconnected between adjacent pairs of upper legs 40 and rear legs 30. The rearward end of each short linkage element 50 is pivotally interconnected to a leg 40 by means of a headed rivet 52 at a point positioned between the upper seat 12 and the lower step 16 as illustrated. The forward end of the linkage elements are connected to the rear legs 30 of the step ladder/chair at a level below the upper ends of the legs by means of a novel stop pin element 54. Each stop pin element extends through an aperture provided in the linkage element 50 and an aligned aperture in the rear legs 30 but also includes an outwardly extending stop portion which is adapted to bear against the forward surface of the upper legs 40 in a stop or limiting function when the step ladder/chair is opened up to the self-supporting, expanded position of FIG. 1 ready for use. As illustrated, the outboard portions of the stop pins 54 provide a positive limit for controlling the maximum angle of divergents of the front and rear legs 20 and 30 on each side of the step ladder/chair structure and in turn, this provides an extremely stable structure which is highly useful for a variety of chores or tasks performed around the household or in a factory environment.

Preferably, the front legs 20, the rear legs 30, the upper legs 40 and the cross-members 32 and 48 are formed of strong, light weight, metal tubing and an appropriate decorative finish such as chrome plating is provided if desired.

The step ladder/chair is light in weight, pleasing in appearance, easy to use and manipulate and can be mass produced on an economical basis for sale to both the householder and the factory owner. The step ladder/chair serves a multiple function as a chair, a step ladder and in addition may find use in supporting a variety of different objects at convenient work levels on the upper seat 12 or lower step 16.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A step ladder/chair combination comprising:

first and second platform means in spaced apart parallel relation for supporting a person/object at levels above the floor or other supporting surface;

a first pair of parallel legs pivotally interconnected to said first and second platform means on opposite sides thereof and depending downwardly of the lower platform means and having feet at their lower ends for supporting contact with said floor or other supporting surfaces;

a second pair of parallel legs pivotally connected to the upper platform means on said opposite sides thereof and depending downwardly with feet at their lower end for supporting contact with said floor or other supporting surface, said feet of said second pair of legs movable toward and away from said feet of said first pair of legs upon relative pivotal movement of said legs between a first position and a second position wherein said feet are spaced farther apart for supporting said step ladder/chair in a self-supporting standing condition on said floor or other supporting surface;

a third pair of parallel legs, parallel of said first parallel legs pivotally interconnected to said first and second platform means on said opposite sides thereof and extending upwardly above said upper platform means for supporting a back rest above said upper platform means;

a pair of linkage elements pivotally interconnected at opposite ends to pairs of adjacent second and third legs intermediate their length between said upper and lower platform means; and a pair of stops adjacent said linkage elements for limiting the relative pivotal movement between adjacent pairs of first and second legs to provide a stable, self-supporting condition of said step ladder/chair with said first and second platform means in spaced parallel relation to said floor or other supporting surface.

2. The step ladder/chair combination of claim 1 wherein said stops comprise pins for pivotally interconnecting said linkage elements and said second legs, which pins engage said second legs to limit the relative pivotal movement between said first and second legs.

3. The step ladder/chair combination of claim 1 wherein said first and second legs are pivotally interconnected to said upper platform means on a common pivot axis.

4. The step ladder/chair combination of claim 1 including a back rest comprising an upper element integral with said third legs and interconnecting the upper ends thereof above said upper platform means.

5. The step ladder/chair combination of claim 4 wherein said back rest includes a second element interconnected between upper portions of said third legs and spaced below said upper element.

6. The step ladder/chair combination of claim 1 including a cross member interconnecting lower end portions of said second legs at a level below said lower platform means.

7. The step ladder/chair combination of claim 6 wherein said cross member comprises a U-shaped element having relatively short legs at opposite ends of a bight portion secured to said second legs.

8. The step ladder/chair combination of claim 2 wherein said linkage elements are pivotally interconnected to said third legs at an elevation above said stop pins.

9. The step ladder/chair combination of claim 2 wherein said pairs of adjacent second and third legs cross one another at a level below said stop pins.

10. The step ladder/chair combination of claim 2 wherein said linkage elements are disposed between legs in each pair of adjacent second and third legs and said stop pins project outwardly in opposite directions for engagement with said second legs to limit the spacing of said feet on each pair of adjacent first and second legs.

* * * * *